US005147409A

United States Patent [19]

Shimura et al.

[11] Patent Number: 5,147,409

[45] Date of Patent: Sep. 15, 1992

[54] AGENT AND METHOD FOR TREATING WOOL FIBERS WHEREIN THE AGENT IS TRIS(HYDROXYPROPYL)PHOSPHINE AND/OR ALKYLENE OXIDE ADDITION PRODUCTS THEREOF

[75] Inventors: Seiji Shimura; Masashi Sugiya; Yoshifusa Hara, all of Tokyo; Kunio Kako, Yokohama; Akira Saito, Tokyo, all of Japan

[73] Assignees: Nippon Chemical Industrial Co., Ltd.; Koizumi Chemical Co., Ltd.; Chiyoda Shoji Co., Ltd., all of Tokyo, Japan

[21] Appl. No.: 360,939

[22] PCT Filed: Sep. 13, 1988

[86] PCT No.: PCT/JP88/00924

§ 371 Date: May 4, 1989

§ 102(e) Date: May 4, 1989

[87] PCT Pub. No.: WO89/02497

PCT Pub. Date: Mar. 23, 1989

[30] Foreign Application Priority Data

| | | | |
|---|---|---|---|
| Sep. 14, 1987 | [JP] | Japan | 62-228378 |
| Jan. 14, 1988 | [JP] | Japan | 63-4679 |
| Jan. 14, 1988 | [JP] | Japan | 63-4680 |

[51] Int. Cl.[5] ..... D06M 11/68

[52] U.S. Cl. ..... 8/128.1; 8/115.51; 8/127.5; 8/584

[58] Field of Search ..... 8/128.1, 584, 127.5, 8/115.51; 423/316

[56] References Cited

U.S. PATENT DOCUMENTS

| | | | |
|---|---|---|---|
| 3,256,154 | 6/1966 | Jenkins et al. | 8/128.1 |
| 3,488,139 | 1/1970 | Vullo | 8/128.1 |
| 3,697,219 | 7/1969 | Richards | 252/917 |
| 3,698,854 | 10/1972 | Donaldson et al. | 8/128.1 |
| 3,723,057 | 3/1973 | Donaldson et al. . | |

FOREIGN PATENT DOCUMENTS

| | | |
|---|---|---|
| 533448 | 12/1954 | Belgium . |
| 48098195 | 5/1976 | Japan . |

*Primary Examiner*—Paul Lieberman
*Assistant Examiner*—Bradley A. Swope
*Attorney, Agent, or Firm*—Oblon, Spivak, McClelland, Maier & Neustadt

[57] ABSTRACT

The present invention discloses an agent and a method of treating wool fibers using the agent which contains as an active ingredient, one or more water-soluble organic phosphine compounds selected from the group comprising hydroxyalkylphosphines expressed by the following formula:

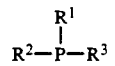

(wherein $R^1$ denotes a hydroxyalkyl group having 1 to 10 carbon atoms and $R^2$ and $R^3$ each denotes an alkyl or hydroxyalkyl group having 1 to 10 carbon atoms) and derivatives thereof such as alkylene oxide addition products, phosphonium salts and quaternary phosphonium compounds thereof.

12 Claims, No Drawings

AGENT AND METHOD FOR TREATING WOOL FIBERS WHEREIN THE AGENT IS TRIS(HYDROXYPROPYL)PHOSPHINE AND/OR ALKYLENE OXIDE ADDITION PRODUCTS THEREOF

TECHNICAL FIELD

The present invention relates to an agent and method for treating wool fibers.

The present invention particularly relates to a novel agent for treating wool fibers which is capable of improving such processing and treating operations of fibers as bleaching, dyeing and treatments for improving shrink resistance and pilling properties, as well as to a rational method of treating wool fibers using this treating agent.

BACKGROUND ART

As is already known, beast wool represented by sheep wool is passed through many processes including the washing of raw wool before it is finally used as fiber products in daily life. Particularly, chemical treatments such as scouring, bleaching, dyeing, shrink resistance and the like are inevitable.

For example, the bleaching of wool fibers is generally carried out by an oxidation bleaching method in which the fibers are treated in a bleaching bath containing an oxidizing agent represented by hydrogen peroxide as an active ingredient, or by a reduction bleaching method in which they are treated in a bleaching bath containing a reducing agent represented by hydrosulfite as an active ingredient.

Wool fibers which are bleached by oxidation are then often bleached again as the after-treatment using a bath containing a thionite-type reducing agent such as hydrosulfite, thiourea dioxide or the like for the purpose of improving their whiteness.

In recent years, an increasing number of textile goods made of wool which are with beads or metallic accessories have been on the market. Such textile goods, however, have the problem that sulfuric gases are generated from traces of reducing agent which remain in the wool and which is used at the after-treatment while they are stored in plastic bags or displayed in the show window, resulting in discoloration of the beads of pearl color to a dark color within 1 or 2 months.

Wool shrinks during processing or during the washing of the processed products owing to the characteristics of the wool structure. Thus, wool may often be treated for shrink resistance.

For example, shrinkproofing of wool fibers is generally treated by adding them in a bath of aqueous solution containing, as an active ingredient, such an agent as chlorinated isocyanurate, potassium permanganate, a peroxide or the like.

Such shrinkresist treatment using the above-described agent for shrinkresistance is, however, generally carried out before dyeing; it is very difficult to carry out shrinkresistance of wool after dyeing as the process may cause discoloring, fading or decoloring of the dyed product or degradation of the wool. When the treatment for shrinkresistance is applied to the dyed wool, therefore, the shrinkresist treatment of conventional methods can not be applied.

The shrinkresistance using the above-described agent involves the problem that the processing conditions are very strict and the control of the bath is very difficult.

It is impossible to impart pilling resistance and shrinkresistance to wool simultaneously by conventional methods.

Dyeing of wool fibers is generally carried out by a high-temperature dyeing method (boiling point dyeing method) which uses a dyeing bath prepared in the following manner. Dyes and some acid such as sulfuric acid, acetic acid, formic acid or the like, some salt such as ammonium sulfate, ammonium acetate or the like, Glauber's salt and some leveling agent or the like are added in dyeing bath. This brings the dyeing bath within the weak acid region or the acid region. The temperature of the dyeing bath is gradually raised from the room temperature to the boiling point and then held at the boiling point for about 60 minutes.

Then, since such a high temperature dyeing method easily degrades the fibrous tissues of wool, low-temperature dyeing methods such as a urea method, a formic acid method, a surfactant method and an organic solvent method in which a dyeing bath is not heated to the boiling point thereof but kept at the lower temperature below the boiling point are now being investigated for the protection of wool fiber quality. Attempts which are made to subject wool suitable for low-temperature dyeing to processing using a bath containing, as an active ingredient, an organic phosphine compound are reported in J, Soc. Dyers & Colourists, Vol. 95, 396, Aust. J. Chem., Vol. 19, 2347-2360 (1966), and Aust. J. Biol. Sci., Vol. 21, 805-813 (1968). Although such a bath is prepared by dissolving tributylphosphine in an aqueous solution of propanol, tributylphosphine is water-insoluble. Thus a water-soluble organic phosphine compound related to the present invention is different from the insoluble compound.

The above-described conventional after treatment subsequent to oxidation bleaching in chemical processing makes it impossible to prevent discoloration of the beads or metallic accessories on wool with the passage of time.

The conventional high-temperature dyeing method also has a disadvantage of degrading wool making it, brittle and inferior in handling touch. But the low-temperature dyeing method has never been achieved in the technical aspect in spite of efforts, and substantially no method has been put into practical use in the industrial field.

As a result of energetic research on processing and treating of wool fibers conducted by the inventors with a view to solving the above-described problem, it was found that the use of an agent containing as an active ingredient a water-soluble organic phosphine compound exhibits significant improvements, particularly, improvement in pilling resistance and that it enables processed wool products of good quality to be obtained. This leads to the achievement of the present invention.

DISCLOSURE OF THE INVENTION

The present invention relates to an agent used for treating wool fibers which contains as an active ingredient one or more water-soluble organic phosphine compounds selected from the hydroxyalkylphosphines expressed by the following formula:

$$R^2-\overset{\overset{\displaystyle R^1}{|}}{P}-R^3 \qquad (1)$$

(wherein $R^1$ denotes a hydroxyalkyl group having 1 to 10 carbon atoms and $R^2$ and $R^3$ each denote an alkyl or hydroxyalkyl group having 1 to 10carbon atoms) and derivatives thereof such as alkylene oxide addition products, phosphonium salts and quaternary phosphonium compounds.

The second invention of the present invention relates to a bath used for treating wool fibers which comprises an aqueous solution containing as an active ingredient an organic phosphine compound expressed by formula (1).

The third invention of the present invention relates to a method of treating wool fibers which is characterized by adding the wool fibers in the above-described bath used for treating them.

The first object of the present invention is to provide wool products with excellent pilling resistance.

The second object of the present invention is to prevent deterioration in the quality of wool products such as accessory beads and to provide wool fibers with fastness to light by performing a certain type of after treatment in place of the conventional after treatment of oxidation or reduction bleaching.

The third object of the present invention is to enable low-temperature dyeing, and also to establish an easy and safe shrinkresistance treatment with only one bath.

The fourth object of the present invention is to enable shrinkproofing of wool fibers to be conducted either before or after the dyeing of the wool fibers, without giving any adverse effect thereon.

The present invention will be described in detail below

The present invention is generally characterized by using an agent for treating wool fibers which contains as an active ingredient one or more water-soluble organic phosphine compounds expressed by the above-described formula (1).

Examples of hydroxyalkylphosphines among such compounds include dimethylhydroxymethylphosphine, thylhydroxyethylphosphine, diethylhydroxypropylphosphine, ethylbis(hydroxyethyl)phosphine, ethylbis(-hydroxypropyl)phosphine, trishydroxymethylphosphine, trishydroxyethylphosphine, trishydroxypropylphosphine, trishydroxybutylphosphine, trishydroxypentylphosphine, trishydroxyhexylphosphine, trishydroxyoctylphosphine and the like.

Examples of alkylene oxide addition products among derivatives of these compounds include ethylene oxide and propylene oxide addition products with the number of moles added within the range of 1 to 5.

Examples of phosphonium salts of derivatives of these compounds include salts which can be formed by the addition of strong acids such as mineral acids, e.g., hydrochloric acid, sulfuric acid, nitric acid, phosphoric acid and the like.

These phosphonium salts can be easily hydrolyzed in the presence of an alkali agent to produce the corresponding hydroxyalkylphosphine.

The quaternary phosphonium compounds are compounds expressed by the following formula:

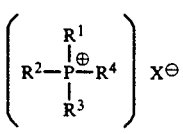

(2)

(wherein R1, R2, R3 each denotes the same group as that described in the formula (1), R4 denotes an alkyl, alkylene, aryl, hydroxyalkyl, carboxyalkyl or cyanoalkyl group, which each has 1 to 8 carbon atoms, and X denotes an anion). Examples of these compounds include tetrakishydroxymethylphosphonium sulfate, tetrahydroxyethylphosphonium iodide, tetrahydroxypropylphosphonium bromide, tetrahydroxybutylphosphonium bromide, tetrahydroxyoctylphosphonium bromide, carboxyethyltris(hydroxyethyl)phosphonium chloride, ethyltris(hydroxypropyl)phosphonium bromide, carboxyethyltris(hydroxypropyl)phosphonium bromide, cyanoethyltris(hydroxypropyl)phosphonium bromide, allyltris(hydroxypropyl)phosphonium chloride, hydroxyethyltris(hydroxypropyl)phosphonium bromide and the like.

These quaternary phosphonium compounds can also be hydrolyzed with an alkali to produce the corresponding hydroxyalkylphosphine in the same manner as with the above described phosphonium salts.

As described above, the compounds used in the present invention are not particularly limited, and any hydroxyalkylphosphine which is soluble in an aqueous medium and any compound which can be hydrolyzed to produce the hydroxyalkylphosphine may be used.

In the present invention, therefore, preferable examples of compounds include compounds expressed by formula (1) because they can be directly used.

The agent used for treating wool fibers in the present invention contains one or more compounds selected from the above-described compounds. This agent is used as an aqueous solution, i.e., a fiber-treating bath. The content of a water-soluble organic phosphine compound in the treating bath is generally 0.005 to 3.0% o.w.m., preferably 0.02 to 2.0% o.w.m., as P contained in the compound used. This is because the use of less than 0.005% o.w.m. of such a compound produces no effect of treating fibers, and the use of over 3.0% o.w.m. of such a compound produces no increase in the effect of treating and is thus economically meaningless. The unit "% o.w.m." used in the present invention represents % by weight relative to the fiber material to be treated In many cases, this treating bath contains auxiliaries such as an acidifying substance, surfactant, pH adjuster, dye, level dyeing agent and the like in appropriate amounts in accordance with the state of the fibers treated and for the purpose of increasing the effect of treating fibers.

The acidifying substance is a compound used for bringing the pH of the treating bath from the neutral to weak acid region, as well as a compound which produces no phosphonium addition salt. Examples of such compounds include carboxylic acids such as formic acid, acetic acid, propionic acid, citric acid, oxalic acid and the like; phosphonic acids; sulfonic acids and the like. Carboxylic acids such as acetic acid and the like are preferable.

The pH adjuster is a compound which has a pH buffer action on the treating bath. Examples of such compounds include alkali monohydrogen phosphate, alkali dihydrogen phosphate, alkali pyrophosphate, alkali tripolyphosphate, alkali borate, alkali acetate and the like.

The surfactant is generally used in treating wool fibers from a commonsense standpoint. Examples of surfactants include anionic surfactants such as carboxylate surfactants, sulfonate surfactants, sulfate surfactants and phosphate surfactants; cationic surfactants such as alkyl amine surfactants; ampholytic surfactants such as carboxybetaine surfactants, aminocarboxylate surfactants, and imidazolinium betaine surfactants; nonionic surfactants such as ether surfactants, ether ester surfactants, ester surfactants and nitrogen-containing surfactants; other fluorine surfactants and the like.

Any dyes which can be used in the dyeing of wool may be used in the present invention. Examples of acid dyes such as self levelling dyes, milling dyes, super-milling dyes and the like; pre metallized dyes such as 1:1 metal complex dyes, 2:1 metal complex dyes; reactive dyes; acid mordant dyes and the like. Among these dyes, reactive dyes are particularly preferable from the viewpoint of colour fastness.

The bath for treating wool fibers used in the present invention comprises an aqueous solution containing the above-described agents. The typical composition and pH of the aqueous solution are set in accordance with the type of the wool fibers used and the main purpose of the relevant processing. In regard to pH, for example, the final pH value of the bath is preferably adjusted in advance so as to be within the range of 3 to 7, which is generally suitable for wool.

The bath used for treating wool fibers in the present invention is mainly characterized by enabling dyeing and shrinkresistance to be produced at the same time by using the bath in combination with a dyeing agent.

Although conventional dyeing methods in many cases utilize the so-called boiling point dyeing which is effected at the temperature of the boiling point of the bath, the use of the treating agent related to the present invention enables low-temperature dyeing to be effected at room temperature to 80° C. As a matter of course, high-temperature dyeing may be performed as occasion demands. It can be said that the possibility of low-temperature dyeing has a very preferable merit from the point that low-temperature dyeing does not degrade the texture of wool fibers.

When treatment is performed for the purpose of increasing the shrinkresistance of wool fibers, the treatment may be performed after dyeing, and also reversely dyeing may be performed after the treatment for shrinkresistance. The treating bath of the present invention can be effectively used for treatment after conventional oxidation bleaching.

It can be pointed out that the processing operations using the treating bath of the present invention in any processing treatment have a common characteristic in that pilling resistance can be provided.

The term "pilling resistance" represents a characteristic that is well known in the field of processing of wool fibers and in that so-called pills are not easily produced in the treated wool owing to external friction. Although pilling has been a problem in the wool industry for many years, such processing for providing pilling resistance has never been achieved. The present invention is, however, capable of providing wool with pilling resistance to a remarkable extent.

The processing of wool fibers using the bath for treating the wool fibers of the present invention has a practical advantage in that it can be performed in a very safe and simple manner as described below.

Wool fibers to be treated are first added to the bath for treating wool fibers of the present invention. This treatment is preferably performed at a ratio by weight between the bath and a fiber product to be treated, i.e., a liquor ratio, of 1:1 to 100:1, preferably 5:1 to 60:1. The temperature of the bath used for adding can be room temperature.

Adding is then performed at room temperature or a temperature of room temperature to 80° C. in accordance with the type of the wool used. In this case, the temperature of the bath used for treating wool fibers is preferably raised at a rate of about 0.5 to 3° C./minute, not producing any rapid reaction. In this way, the temperature of the treating bath is raised and then held at a required level. The holding time of the temperature is not particularly limited, but it is generally within the range of 5 to 60 minutes, preferably 20 to 40 minutes, at the peak temperature.

Although the treatment carried out the above-described manner causes the organic phosphine compound to be oxidized and thus the pH value of the bath to be gradually decreased, since the degree of decrease in pH is generally within the range of 0.4 to 0.6, pH can be easily set in advance and the bath can be easily controlled. If the initial pH value of the bath is set at 5.0, therefore, the bath having the final pH value of 4.4 to 4.6 which is optimum for wool fibers can be obtained The pH can therefore be controlled so that the processing is stopped after a desired time has passed, at which the pH value becomes stable.

After this processing has been completed, after treatment such as rinsing and drying may be carried out by the usual method. However, it is preferable to carry out neutralization treatment using a strong acid which is capable of forming a phosphonium salt, immediately after this processing. In the present invention, it is particularly preferable to conduct such after treatment using an aqueous solution of sulfuric acid or an alkali bisulfate such as sodium bisulfate or potassium bisulfate. This after treatment is performed for the purpose of removing a small amount of phosphine compound which remains in fibers. From this viewpoint, an oxidizing agent may be used in this after treatment. However, the use of a strong acid, particularly sulfuric acid or an alkali bisulfate, does not degrade fibers, as well as enabling fibers to be finished with good handling touch.

The conditions of this after treatment such as the liquor ratio, the concentration of the bath, the bath temperature and the like may be substantially the same as those described above.

This after treatment is capable of eliminating the reducing effect of the water-soluble organic phosphine compound which remains in the wool fibers treated.

The processing of wool fibers of the present invention is then finished after rinsing and drying have been carried out by the usual method. If required, softening treatment may be carried out by the usual method after the processing of the present invention.

Representative examples of wool that may be treated with the agent for treating wool fibers of the present invention include sheep wool, goat hair, rabbit hair, camel hair and the like and mixed hair thereof. Examples of wool fibers include raw hair which is not spun, yarns, clothes and knitted garments which are all produced by processing raw hair, and various processed fiber products such as clothes, and wool fibers are not particularly limited.

FUNCTION

Although the detailed mechanism of the function of the agent for treating wool fibers of the present invention on wool fibers is not known, it is thought that the processing is satisfactorily effected owing to the cleavage of the —SS— bond of cystine which is a component of the protein texture of wool fibers which is caused by water-soluble phosphorus having a reducing power.

For example, if dyeing is effected in a bath using the treating agent of the present invention, the organic phosphine compound is oxidized with the progressive cleavage of —SS— bonds, while the pH of the bath decreases, whereby the absorption of the dye used starts slowly and then gradually progresses. There are therefore no occurrences of a tippy effect in that the degree of dyeing at the ends of wool fibers is different from that of the remainder thereof and no occurrence of skitteriness which is an undesired speckled effect arising from differences in colour between adjacent fibres or portions of the fibre, whereby level dyeing can be effected. Since no faulty dyeing occurs, level dyeing can be effected.

The water-soluble organic phosphine compound of the present invention is a reducing agent, as described above, and can thus be used as a bath for the after treatment after the conventional oxidation bleaching treatment, as well as a bath for shrinkresistance.

It is thought that these treating baths have a common function to cleave the —SS— bonds without degrading wool fibers and consequently provide wool fibers with excellent pilling resistance.

EXAMPLE

The present invention will be described in detail below with reference to examples and comparative examples.

EXAMPLE 1

Agent for Treating Wool Fibers (Dyeing Bath)

A dyeing bath comprising an aqueous solution having the composition described below was prepared.

C. I. Acid Yellow 121 (produced by ICI Co., Ltd.): 1.0% o.w.m.
C. I. Acid Red 359 (produced by ICI Co., Ltd.): 1.0% o.w.m.
C. I. Acid Black 188 (produced by ICI Co., Ltd.): 1.0% o.w.m. 90% Acetic acid: 1.35 cc/l
Disodium dihydrogen pyrophosphate: 0.9 g/l
Trisodium monohydrogen pyrophosphate: 0.1 g/l
Levelling agent (Unisol WL, produced by ICI Co., Ltd.): 2.35% o.w.m.
Tris(3-hydroxypropyl)phosphine: 4.73% o.w.m.
$P(C_3H_6OH)_3$: (0.70% o.w.m. as P)

COMPARATIVE EXAMPLE 1

Agent for Treating Wool Fibers (Conventional Dyeing Bath)

A dyeing bath comprising an aqueous solution having the composition described below was prepared corresponding to Example 1.

C. I. Acid Yellow 121: 1.0% o.w.m.
C. I. Acid Red 359: 1.0% o.w.m.
C. I. Acid Black 188: 1.0% o.w.m.
90% Acetic acid: 0.8 cc/l
Disodium dihydrogen pyrophosphate: 2.25 g/l
Trisodium monohydrogen pyrophosphate: 0.25 g/l Levelling agent (Unisol WL): 2.35% o.w.m.

EXAMPLE 2

Dyeing Bath

A dyeing bath comprising an aqueous solution having the composition described below was prepared C. I. Reactive Yellow 39 (produced by Ciba Geigy Co., Ltd.): 1.0% o.w.m.
C. I. Reactive Red 84 (produced by Ciba Geigy Co., Ltd.): 1.0% o.w.m.
C. I. Reactive Blue 69 (produced by Ciba Geigy Co., Ltd.): 1.0% o.w.m.
90% Acetic acid: 1.35 cc/l
Disodium dihydrogen pyrophosphate: 0.9 g/l
Trisodium monohydrogen pyrophosphate: 0.1 g/l
Levelling agent (Unisol WL): 2.35% o.w.m.
Tris(3-hydroxypropyl)phospine: 4.73% o.w.m.
$P(C_3H_6OH)_3$: (0.70% o.w.m. as

COMPARATIVE EXAMPLE 2

A conventional dyeing bath comprising an aqueous solution having the composition described below was prepared corresponding to Example 2.

C. I. Reactive Yellow 39: 1.0% o.w.m.
C. I. Reactive Red 84: 1.0% o.w.m.
C. I. Reactive Blue 69: 1.0% o.w.m.
90% Acetic acid: 0.8 cc/l
Disodium dihydrogen pyrophosphate: 2.25 g/l
Trisodium monohydrogen pyrophosphate: 0.25 g/l
Levelling agent (Unisol WL): 2/35% o.w.m.

EXAMPLE 3

A dyeing bath comprising the aqueous solution having the composition described below was prepared.

C. I. Acid Yellow 127 (produced by Nippon Kayaku Co., Ltd.): 1.0% o.w.m.
C. I. Acid Red 138 (produced by Nippon Kayaku Co., Ltd.): 1.0% o.w.m.
C. I. Acid Blue 138 (produced by Nippon Kayaku Co., Ltd.): 1.0% o.w.m.
90% Acetic acid: 1.35 cc/l
Disodium dihydrogen pyrophosphate: 0.9 g/l
Trisodium monohydrogen pyrophosphate: 0.1 g/l
Levelling agent (Unisol WL): 2.35% o.w.m.
Tris(3-hydroxypropyl)phospine: 4.73% o.w.m.
$P(C_3H_6OH)_3$: (0.70% o.w.m. in terms of P)

COMPARATIVE EXAMPLE 3

A conventional dyeing bath comprising an aqueous solution having the composition described below is prepared corresponding to Example 3.

C. I. Acid Yellow 127: 1.0% o.w.m.
C. I. Acid Red 138: 1.0% o.w.m.
C. I. Acid Blue 138: 1.0% o.w.m.
90% Acetic acid: 0.8 cc/l
Disodium dihydrogen pyrophosphate: 2.25 g/l
Trisodium monohydrogen pyrophosphate: 0.25 g/l
Levelling agent (Unisol WL): 2.35% o.w.m.

EXAMPLE 4

A dyeing bath comprising an aqueous solution having the composition described below was prepared C. I. Acid Yellow 121: 1.0% o.w.m.
C. I. Acid Red 359: 1.0% o.w.m.
C. I. Acid Black 188: 1.0% o.w.m.
90% Acetic acid: 1.35 cc/l
Disodium dihydrogen pyrophosphate: 0.9 g/l
Trisodium monohydrogen pyrophosphate: 0.1 g/l
Levelling agent (Unisol WL): 2.35% o.w.m.
$P[C_3H_6O(C_2H_4O)_4H]_3$: 16.79% o.w.m. (0.71% o.w.m. as P)

1) Dyeing Method for Example 1 to 4

A wool yarn comprising 50% lamb wool and 50% merino wool (referred to as "wool yarn" hereinafter)

was added in each of the dyeing baths formed in Examples 1 to 4 at a liquor ratio of 20:1. The temperature of each bath was room temperature. After the wool yarn had been added, the temperature of each bath was raised at a rate of 1° C./minute to 70° C. which was then held for 35 minutes. The initial and final pH values of each of the baths are shown in Table 1.

After dyeing had been completed, the wool yarn was subjected to acid treatment using a bath containing of sodium bisulfate (2% o.w.m.) at a liquor ratio of 20:1 and 60° C. for 20 minutes.

After the acid treatment had been completed, the wool yarn was scoured in 2 g/l of detergent (Nonion Anion FWA-260, produced by Ipposha Fat & Oil Industry Co., Ltd.): at a liquor ratio of 20:1 and 60° C. for 20 minutes. The woolen yarn was then rinsed with water twice and then centrifuged and dried to obtain a product.

2) Dyeing Method for Comparative Example 1 to 3

A wool yarn comprising 50% lamb wool and 50% merino wool was added in a shrinkresistance bath described below at a liquor ratio of 20:1 which was made neutral by adding acetic acid in the bath, and then treated at 18° C. for 40 minutes. The thus-treated yarn was then scoured with water and then added in a bath at a liquor ratio of 20:1 which contained 10% o.w.m. of anhydrous acid sodium sulfite and which has a pH value controlled to 5.5 by adding acetic acid thereto After the yarn had been treated at room temperature for 30 minutes, it was rinsed with water, hot water and again water.

Shrinkresistance Bath

Detergent [Nonion Anion FWA-260 (produced by Ipposha Fat & Oil Industry Co., Ltd.]: 0.5% o.w.m.

Levelling agent (Unizole WL): 1% o.w.m.

Potassium chlorinated isocyanurate:4% o.w.m.

Potassium permanganate: 2% o.w.m.

Anhydrous Glauber's salt: 10 g/l

The thus treated wool yarn which was shrink resistant was then added in each of the dyeing baths prepared in Comparative Examples 1 to 3 at a liquor ratio of 20:1 and at room temperature. After the wool yarn had been added, the temperature of each bath was raised at a rate of 1° C./minutes and then held for 45 minutes after boiling. The initial and final pH value of each bath are shown in Table 1.

After dyeing had been completed, the wool yarn was scoured in a bath containing 2 g/l of detergent (Nonion Anion FWA-260, produced by Ipposha Oil & Fat Industry Co., Ltd.) at a liquor ratio of 20:1 and 60° C. for 20 minutes. The wool yarn was then rinsed with water twice, centrifuged and then dried to obtain a product.

TABLE 1

| | pH | |
|---|---|---|
| | Initial (24° C.) | Final (29° C.) |
| Example 1 | 5.16 | 4.61 |
| Example 2 | 4.94 | 4.58 |
| Example 3 | 5.10 | 4.66 |
| Example 4 | 5.26 | 4.93 |
| Comparative Example 1 | 4.58 | 4.93 |
| Comparative Example 2 | 4.55 | 4.86 |
| Comparative Example 3 | 4.50 | 4.95 |

3) Method of Evaluation

In order to evaluate each of the dyed wool specimens obtained by dyeing, the value of L, a, b, Hunter whiteness, and the color difference were determined using a color-difference meter (produced by Nippon Denshoku Industry Co., Ltd., ND-101DP type). The results obtained are shown in Tables 2 and 3.

TABLE 2

| | L | a | b | W |
|---|---|---|---|---|
| Example 1 | 17.9 | 3.6 | 2.9 | 17.77 |
| Example 2 | 20.0 | 1.2 | 3.4 | 19.92 |
| Example 3 | 19.5 | 6.2 | −2.5 | 19.22 |
| Example 4 | 18.3 | 3.2 | 3.4 | 18.17 |
| Comparative Example 1 | 18.3 | 3.7 | 3.0 | 18.16 |
| Comparative Example 2 | 20.7 | 1.3 | 3.3 | 20.62 |
| Comparative Example 3 | 19.9 | 6.1 | −2.7 | 19.62 |

(Note)

(1) The greater the L value, the greater the degree of brightness.
The greater the a value, the greater the degree of redness.
The greater the b value, the greater the degree of yellowness.

(2) W represents the Hunter whitness which was determined by the equation described below. The smaller the value of W, the higher the shade depth, while the greater the value of W, the greater the degree of pale shade (undyed).

$$W = 100 - \sqrt{(100 - L)^2 + a^2 + b^2}$$

TABLE 3

| Contrast | | | |
|---|---|---|---|
| Example | Comparative Example | ΔE | Sensuous Difference |
| 1 | 1 | 0.42 | Trace |
| 2 | 2 | 0.71 | Slight |
| 3 | 3 | 0.46 | Trace |
| 4 | 1 | 0.64 | Slight |

(Note)

(1) ΔE represents a color difference of the NBC unit.

$$\Delta E = \sqrt{\Delta L^2 + \Delta a^2 + \Delta b^2}$$

ΔL = L value of Example − L value of Comparative Example
Δa = a value of Example − a value of Comparative Example
Δb = b value of Example − b value of Comparative Example As can be seen from the above-described effects, the treatment using the dyeing bath of the present invention enables low-temperature dyeing with an effect of dyeing which is by no means inferior to conventional boiling-point dyeing. It was also apparently found from the evaluation of the dyed fibers that shrinkresistance and pilling resistance are significantly imparted to the fibers. Namely, processing of fibers can be carried out in only one bath.

In order to clarify this point, the examples described below were conducted.

EXAMPLE 5

Bath for Shrinkresistance of Wool Fibers

Preparation

A bath for shrinkresistance wool fibers at pH 5 comprising an aqueous solution having the composition described below was prepared.

Tris(3-hydroxypropyl)phospine $P(C_3H_6OH)_3$: 7.5% o.w.m. (1.11% o.w.m. as P)

Levelling agent (Unisol WL): 2.35% o.w.m.

Trisodium monohydrogen pyrophosphate: 0.1 g/l

Disodium dihydrogen pyrophosphate: 0.9 g/l

90% Acetic acid: 1.8 g/l

Shrinkresistance Method

In this example, the treatment was employed after dyeing had been performed. A knit garment of 100% wool was added at a liquor ratio of 30:1 in a dyeing bath having the following composition:

C. I. Reactive Yellow 39: 0.3% o.w.m.

C. I. Reactive Red 84: 0.3% o.w.m.

C. I. Reactive Blue 69: 0.3% o.w.m.

Ammonium sulfate: 4% o.w.m.

Albegal B (produced by Ciba Geigy Co., Ltd.): 1.5% o.w.m.

Acetic acid: 1 cc/l

The adding was carried out at room temperature. The temperature of the bath was then raised to 90° C. at a rate of 1° C./minute in about 60 minutes and then held at 90° C. for about 40 minutes until dyeing was completed.

After the dyeing had been completed, the knit garment was treated with an aqueous solution containing 25% aqueous ammonia (2% o.w.m.) at a liquor ratio of 30:1 and 40° C. for 10 minutes, and then rinsed with water.

The thus-dyed wool was then added in the bath for shrinkresistance of wool fibers prepared in the above-described manner at a liquor ratio of 30:1 at room temperature. The temperature was then raised to 75° C. at a rate of 1° C./minute in about 45 minutes and then held at 75° C. for about 20 minutes until the treatment was completed. After the treatment had been completed, the wool was carried in an aqueous solution containing 3% o.w.m. of sodium bisulfate at a liquor ratio of 30:1 at 40° C. for 10 minutes and then dried to obtain the product.

COMPARATIVE EXAMPLE 4

Preparation of Conventional Bath for Shrinkresistance of Wool Fibers

A bath for shrinkresistance of wool fibers comprising an aqueous solution containing the components described below was prepared, and the pH of the thus-prepared bath was adjusted to a neutral value by adding acetic acid thereto.

Potassium chlorinated isocyanurate: 4% o.w.m.

Potassium permanganate: 2% o.w.m.

Nonionic surfactant: 0.5% o.w.m.

Anionic surfactant: 1% o.w.m.

Anhydrous Glauber's salt: 20% o.w.m.

Shrinkresistance and Dyeing Method

A knit garment comprising 100% wool was added in the above described shrinkresistance bath at a liquor ratio of 30:1 and then treated by being held at 15 to 18° C. for 40 minutes. The knit garment was then rinsed with water and added at a liquor ratio of 30:1 in an aqueous solution containing o.w.m. of sodium bisulfate which was made weakly acid by adding acetic acid thereto. The knit garment was treated by being held at room temperature for 30 minutes and rinsed with water and hot water, repeatedly.

The thus treated wool was then dyed using the same bath and the same operation as those employed in Example 5 to obtain a product.

Method of Evaluating Processed Fibers i) Dyeing shade was evaluated by a color-difference meter.

ii) Colour fastness to washing was evaluated in accordance with JIS L0844 A-2.

iii) Colour fastness to light was evaluated in accordance with the third exposure method of JIS L0842.

iv) Shrinkage tests were conducted in accordance with IWS TM31 (ISO 5A and 7A cycle 2).

v) Tests of pilling resistance were conducted for 5 hours in accordance with ICI-type method of JIS L1076.

The characteristics of products of Example 5 and Comparative Example 4 are shown in Table 4.

TABLE 4

| | Example 5 | Comparative Example 4 |
|---|---|---|
| L | 32.9 | 32.8 |
| a | 2.82 | 2.86 |
| b | 5.7 | 5.64 |
| Colour difference ΔE | 0.123 (trace) | |
| Colour fastness to washing | | |
| Discolouration | 4/5 | 4/5 |
| Silk staining | 5 | 5 |
| Cotton staining | 5 | 5 |
| Colour fastness to light | 5 | 4 |
| Pilling resistance | 4 | 1 |
| Shrink resistance | | |
| Relaxation shrinkage area | 0% | 1.4% |
| Felt shrinkage area | 0% | 35.8% |

As can be seen from the above table, the treating agent of the present invention provides wool with excellent shrinkresistance and pilling resistance.

EXAMPLE 6

Preparation of Bath for Shrinkresistance of Wool Fibers

A bath for shrinkresistance of wool fibers at pH 5 comprising an aqueous solution containing the components described below was prepared.

$P[C_3H_6O(C_2H_4O)_4H]_3$: 25.18% o.w.m. (1.07% o.w.m. as P)

Levelling agent (Unisol WL, produced by ICI Co., Ltd.): 2.35% o.w.m.

Trisodium monohydrogen pyrophosphate: 0.1 g/l

Disodium dihydrogen pyrophosphate: 0.9 g/l

90% Acetic acid: 1.35 cc/l

Dyeing and Shrinkresistance method

A knit garment comprising 100% wool was added in a dyeing bath containing the dyeing components described below at a liquor ratio of 30:1 and at room temperature. The temperature of the bath was then raised to 95° C. at a rate of 1° C./minute in about 65 minutes and then held at 95° C. for about 40 minutes.

C. I. Mordant Black 11: 3% o.w.m.

C. I. Mordant Black 7: 3% o.w.m.

Level dyeing agent (Unizole WL): 1% o.w.m.

90% Acetic acid: 1 cc/l

After the temperature was cooled down to 80° C., 1% o.w.m. of 90% acetic acid and 1% o.w.m. of potassium bichromate were added to the bath which was then held at 80° C. for 5 minutes The temperature was then raised to 95° C. at a rate of 1° C./minute and held at 95° C. for 20 minutes 1% o.w.m. of lactic acid was then added to the bath which was then held at 95° C. for 10 minutes until dyeing was completed.

The thus-dyed knit garment was then added in a bath comprising an aqueous solution containing the components described below at a liquor ratio of 30:1 at 60° C. for 10 minutes, and then rinsed with water, containing below.

Nonionic surfactant: 1 g/l (Dianol 45, produced by Shin-nakamura Chemical Industry Co., Ltd.)

Anionic surfactant: 1 g/l (Persoft SL, produced by Nippon Oil & Fat Co., Ltd.)

The thus-dyed wool was then added in the bath for shrinkresistance treatment of wool fibers at a liquor ratio of 30:1 at room temperature The temperature of the bath was raised to 75° C. at a rate of 1° C./minute in about 45 minutes and then held at 75° C. for about 20 minutes until shrinkresistance and pilling resistance treatments have been completed.

After shrinkresistance treatment had been completed, the wool was treated with an aqueous solution containing 2% o.w.m. of sodium bisulfate at a liquor ratio of 30:1 and at 40° C. for 10 minutes and then dried to obtain a product. The characteristics of the thus treated product are shown in Table 5.

COMPARATIVE EXAMPLE 5

The same knit garment comprising 100% wool as that used in Example 6 was subjected to treatment for shrinkresistance by the same operation as that employed in Comparative Example 4. The knit garment was then dyed by the same operation as that employed in Example 6 to obtain a product. The characteristics of the product obtained are shown in Table 5.

TABLE 5

| | Example 6 | Comparative Example 5 |
|---|---|---|
| L | 16.5 | 16.6 |
| a | −0.7 | −0.7 |
| b | 1.85 | 1.9 |
| Colour difference ΔE | 0.111 (trace) | |
| Colour fastness to washing | | |
| Discolouration | 5 | 5 |
| Silk staining | 4/5 | 4/5 |
| Cotton staining | 4/5 | 4/5 |
| Colour fastness to light | 4/5 | 4/5 |
| Pilling resistance | 3 | 1 |
| Shrink resistance | | |
| Relaxation shrinkage area | 1% | 4.5% |
| Felt shrinkage area | 2.5% | 42.1% |

EXAMPLE 7

Preparation of Bath for Shrinkresistance Treatment of Wool Fibers

A bath for shrinkresistance treatment of wool fibers at pH 5 comprising an aqueous solution containing the components described below was prepared.

Tris(3-hydroxypropyl)phospine: 7.5% o.w.m.

$P(C_3H_6OH)_3$: (1.11% o.w.m. as P)

Levelling agent (Unisol WL): 2.35% o.w.m.

Trisodium monohydrogen pyrophosphate: 0.1 g/l

Disodium dihydrogen pyrophosphate: 0.9 g/l

90% Acetic acid: 1.8 g/l

Shrinkresistance and Dyeing Method

A Knit garment comprising 100% wool was added in the prepared bath for shrinkresistance treatment of wool fibers at a liquor ratio of 30:1 and at room temperature.

The temperature of the bath was then raised to 75° C. at a rate of 1° C./minute in about 45 minutes and held at 75° C. for about 20 minutes until shrinkresistance treatment was completed. After the shrinkresistance treatment had been completed, the knit garment was treated with an aqueous solution containing 3% o.w.m. of sodium bisulfate at a liquor ratio of 30:1 and at 40° C. for 10 minutes. The thus-treated knit garment was then dyed by the same operation as that employed in Example 5 to obtain a product.

The characteristics of the thus-obtained product are shown in Table 6 in comparison with Comparative Example 4.

TABLE 6

| | Example 7 | Comparative Example 4 |
|---|---|---|
| L | 33.0 | 32.8 |
| a | 2.90 | 2.86 |
| b | 5.80 | 5.64 |
| Colour difference ΔE | 0.259 (trace) | |
| Colour fastness to washing | | |
| Discolouration | 4/5 | 4/5 |
| Silk staining | 5 | 5 |
| Cotton staining | 5 | 5 |
| Colour fastness to light | 4/5 | 4 |
| Pilling resistance | 4 | 1 |
| Shrink resistance | | |
| Relaxation shrinkage area | −2% | 1.4% |
| Felt shrinkage area | 2.5% | 35.8% |

EXAMPLE 8

Bleaching of wool was carried out by the following method:

Bleaching

| | |
|---|---|
| (1) Object Fiber | |
| 100% Wool knit garment | |
| (2) Bleaching Bath | |
| 35% hydrogen peroxide | 40% o.w.m. |
| Trisodium 1-hydroxyethylidene-1, 1-disphosphonate | 1.6 g/l |
| Urea | 5 g/l |
| Nonion anion surfactant | 2 g/l |
| Trisodium monohydrogen pyrophosphate | 0.25 g/l |
| Disodium dihydrogen pyrophosphate | 1 g/l |
| Disodium phosphate heptahydrate | 2.5 g/l |
| (3) Condition of Bleaching | |
| Liquor ratio | 20:1 |

Temperature and time:

The temperature was raised from room temperature to 60° C. at a rate of 1° C./minute and then held at 60° C. for 120 minutes.

After bleaching had been completed in this way, the wool garment was scoured with hot water and then water, and then subjected to the after treatment described below.

After Treatment (1) Preparation of After Treatment Bath

A bath for after treatment of after bleaching comprising the aqueous solution having the composition described below was prepared.

Tris(3-hydroxypropyl)phospine $P(C_3H_6OH)_3$: 8.0% o.w.m. (1.1% o.w.m.)

Levelling agent (Unisol WL): 2.35% o.w.m.

Trisodium monohydrogen pyrophosphate: 0.1 g/l

Disodium dihydrogen pyrophosphate: 0.9 g/l

90% Acetic acid: 1.8 g/l pH: 5.0

(2) Condition of After Treatment

Liquor ratio 20:1

Temperature and time:

The temperature was raised from room temperature to 75° C. at a rate of 1° C./minute and then held at 75° C. for 20 minutes.

After the after treatment had been completed in this way, the wool was treated with a solution containing 2% o.w.m. sodium bisulfate at a liquor ratio of 20:1 and at 40° C. for 10 minutes and then dried.

COMPARATIVE EXAMPLE 6

After bleaching had been finished in the same way as that employed in Example 8, treatment was carried out using an after treatment bath containing hydrosulfite having the composition described below.

After Treatment (1) Preparation of Bath for after treatment

Hydrosulfite: 5 g/l

90% Acetic acid: 0.5 g/l

Disodium dihydrogen pyrophosphate: 1 g/l pH: 4.5

(2) Condition of After Treatment

Liquor ratio: 20:1

Temperature and time:

The temperature was raised to 50 to 60° C. at a rate of 1° C./minute and then held at 60° C. for 20 minutes.

After the after treatment had been completed in this way, the wool was scoured with hot water then water and then dried.

Results of evaluation were shown in Table 7.

TABLE 7

| | Example 8 | Comparative Example 6 |
|---|---|---|
| L | 86.35 | 83.38 |
| a | 0.88 | 0.98 |
| b | 6.50 | 6.58 |
| Hunter Whiteness (W) | 84.86 | 82.10 |
| Colour fastness to light | 4/5 | 2.3 |
| Pilling resistance | 4 | 1 |
| Beads trouble resistance | Not discoloured | Discoloured to pitch dark |

EXAMPLES 9 TO 13

The same wool as that used in Example 8 was subjected to bleaching and after treatment with the exception that each of the water-soluble organic phosphine compounds shown in Table 8 was used in place of tris(3-hydroxypropyl)phosphine used in the bath for treatment after bleaching in Example 8. The results of evaluation are shown in Table 9.

The treating agent which was hydrolyzed with an aqueous solution of 2 wt% NaOH was used in each of Examples 11 to 13.

TABLE 8

| Example | Agent for treating wool fibers | % o.w.m. as P |
|---|---|---|
| 9 | Tris(3-hydroxymethyl)phosphine | 1.17 |
| 10 | Tris(3-hydroxyethyl)phosphine | 1.18 |
| 11 | Phosphate of tris(3-hydroxypropyl)phosphine | 1.16 |
| 12 | Sulfate of tris(3-hydroxyethyl) phosphine | 1.18 |
| 13 | Ethyltris(3-hydroxypropyl-phosphonium bromide | 1.20 |

TABLE 9

| Example | 9 | 10 | 11 | 12 | 13 |
|---|---|---|---|---|---|
| L | 86.25 | 86.32 | 86.33 | 86.12 | 85.15 |
| a | 0.89 | 0.92 | 0.88 | 0.87 | 0.83 |
| b | 6.53 | 6.35 | 6.50 | 6.45 | 6.58 |
| Hunter Whiteness(W) | 84.76 | 84.35 | 84.30 | 84.60 | 84.10 |
| Colour fastness to light | 4/5 | 4/5 | 4/5 | 4/5 | 4/5 |
| Pilling resistance | 4 | 4 | 4 | 4 | 4 |
| Beads trouble resistance | Not discoloured | | | | |

Effect of the Invention

The processing using the agent for treating wool fibers of the present invention has the following characteristic advantages:

1. A treating bath containing the agent for treating wool fibers of the present invention and dyeing components enables low-temperature dyeing which is carried out from room temperature to 80° C. This leads to reduced degradation of wool and also better handling touch as compared with conventional boiling point dyeing methods. It is also possible to provide to level dyeing without any tippy dyeing or skitteriness.

In addition, the treating bath can easily be controlled and the reproducibility of dyeing is improved.

2. It is possible to provide wool fibers with excellent shrinkresistance. Since shrinkresistance treatment may be carried out either previous to or subsequent to dyeing, the degree of freedom of use of the treating bath is greater than that of a conventional method of imparting shrinkresistance which should be carried out before dyeing.

3. It is possible to provide wool fibers with excellent pilling resistance regardless of the type of the treating bath used.

This effect is surprising and has never been exhibited by conventional agents for treating wool fibers.

4. When the agent of the present invention for treating wool fibers is used as a treating agent after bleaching, the wool fibers treated are provided with better fastness to light.

What is claimed is:

1. A method for treating wool fibers which comprises adding wool fibers to an aqueous bath solution at pH 2 to 7 which consists essentially of an aqueous solution of one or more water soluble organic phosphine compounds selected from the group consisting of tris(hydroxypropyl)phosphine and alkylene oxide addition products thereof, in an amount of 0.005 to 3.0% o.w.m. as P; and acidified with weak acid to pH 2 to 7 so that no phosphonium addition product is produced, at a temperature from room temperature to 100° C., at a ratio of 1:1 to 100:1.

2. A method of treating wool fibers according to claim 1, wherein said treatment is carried out in such a manner that said wool fibers are added to the aqueous bath solution and held therein until the change in pH becomes stable.

3. A method of treating wool fibers according to claim 1 or 2, wherein said treatment is carried out at room temperature and then the temperature is raised at a rate of about 0.5 to 3° C./minute and then held at a peak temperature lower than 100° C. for 5 to 60 minutes.

4. A method of treating wool fibers according to claim 1 or 2 wherein said wool fibers are subjected to after treatment in an aqueous acid solution of sulfuric acid after they have been subjected to said treatment.

5. A method of treating fur fibers according to claim 1 or 2 characterized by dyeing treatment using a bath for dyeing wool fibers which comprises an aqueous solution at pH 2 to 7 containing as active ingredients a dye and said water soluble organic phospine in amounts of 0.005 to 3.0% o.w.m. in terms of P.

6. A method of treating wool fibers according to claim 1 or 2 characterized by, previous to or subsequent to the dyeing of said wool fibers, adding said wool fibers in a bath for treating wool fibers comprising an aqueous solution at pH 2 to 7 which contains said water soluble organic phospine in an amount of 0.005 to 3.0% o.w.m. as P as an active ingredient and an acidifying agent, a pH adjuster and a surfactant as auxiliary components so as to provide shrink-resistance and pilling resistance for said wool fibers.

7. A method of treating wool fibers according to claim 1 or 2 characterized by, after oxidation or reduction bleaching treatment of said wool fibers, adding said wool fibers in a bath for treating wool fibers comprising an aqueous solution at pH 2 to 7 which contains said water soluble organic phosphine compound in an amount of 0.005 to 3.0% o.w.m. as P as an active ingredient and auxiliary components selected from the group consisting of an acidifying agent, a pH adjuster and a surfactant so as to treat said wool fibers subsequent to the bleaching.

8. A method of treating wool fibers according to claim 1, wherein said water-soluble organic phosphine is tris(hydroxypropyl)phosphine or $P[C_3H_6O(C_2H_4O)_4H]_3$.

9. A method of treating wool fibers according to claim 1 or 2, wherein said wool fibers are those sheared from sheep, goat, rabbit, camel or mixtures thereof.

10. An agent for treating wool fibers consisting essentially of one or more water soluble organic phosphine compounds selected from the group consisting of tris(-hydroxypropyl)phosphine and alkylene oxide addition products thereof dissolved in an aqueous solution and acidified with weak acid to pH 2 to 7 so that no phosphonium addition product is produced.

11. A composition of claim 10 wherein said water soluble organic phosphine is tris(hydroxypropyl phosphine).

12. An agent for treating wool fibers containing, as an active ingredient, $P[C_3H_6O(C_2H_4O)_4H]_3$, dissolved in an aqueous solution and acidified with weak acid to pH 2 to 7 so that no phosphonium addition product is produced.

* * * * *